US005107602A

United States Patent [19]

Lööf

[11] Patent Number: 5,107,602

[45] Date of Patent: Apr. 28, 1992

[54] METHOD AND AN APPARATUS FOR DRYING VENEER AND SIMILAR PRODUCTS

[76] Inventor: Nils O. T. Lööf, Lanternavägen 12,, S-547 02 Otterbäcken, Sweden

[21] Appl. No.: 623,738

[22] PCT Filed: Jul. 13, 1989

[86] PCT No.: PCT/SE89/00412

§ 371 Date: Dec. 20, 1990

§ 102(e) Date: Dec. 20, 1990

[87] PCT Pub. No.: WO90/00713

PCT Pub. Date: Jan. 25, 1990

[30] Foreign Application Priority Data

Jul. 15, 1988 [SE] Sweden ..... 8802655

[51] Int. Cl.[5] ..... F26B 3/34

[52] U.S. Cl. ..... 34/1 V; 34/18; 34/68; 219/10.55 A

[58] Field of Search ..... 34/1, 18, 60, 68; 219/10.55 R, 10.55 M, 10.71

[56] References Cited

U.S. PATENT DOCUMENTS 3,460,265 8/1969 Smith, Jr. ..... 34/1
3,474,544 10/1969 Holden, Jr. et al. ..... 34/18
3,491,457 1/1970 Schreiber et al. ..... 34/1
3,507,050 4/1970 Smith et al. ..... 34/1
3,721,013 3/1973 Miller ..... 34/1
4,234,775 11/1980 Wolfberg et al. ..... 219/10.55 A
4,511,778 4/1985 Takahashi et al. ..... 219/10.55 A

FOREIGN PATENT DOCUMENTS 2160958 1/1986 United Kingdom ..... 34/1

*Primary Examiner*—Henry A. Bennet
*Assistant Examiner*—Denise L. Gromada
*Attorney, Agent, or Firm*—Sughrue, Mion, Zinn, Macpeak and Seas

[57] ABSTRACT

The invention relates to the drying of veneer and similar products. It provides a solution to the problem of such products, after having passed through a hot air drier, exhibiting local areas having an intolerantly high moisture content—they are "underdried". According to the invention those areas are dried with microwave energy. The products (4) pass through the near field of the microwave energy present as standing waves in transverse ducts (6) also supplying the hot air and having openings (11) through which the microwave energy is tapped. Together they cover all of the adjacent product surface, but energy is only tapped through those of them past which underdried areas travel.

6 Claims, 2 Drawing Sheets

METHOD AND AN APPARATUS FOR DRYING VENEER AND SIMILAR PRODUCTS

BACKGROUND OF THE INVENTION

This invention relates to a method and an apparatus for drying veneer and similar products which in the form of a number of sheets or webs are caused to pass through a drying apparatus, especially of the roller type, where the product is dried by means of the flow of hot air and is, during its passage through the apparatus, also exposed to microwave energy radiation which for the purpose of drying underdried zones is applied via transverse ducts.

When the sheets, which are rather thin, a typical thickness being a few millimeters, have left the roller drier they are supplied to a multiple-opening press where, at each press level, a number of sheets are placed on top of each other and glued to form a plywood board. The gluing operation takes place at an elevated temperature.

When the wooden sheets are dried with hot air only they partially get underdried so that they, when leaving the drier, have zones with a high humidity content. Portions comprising such zones must be redried before the sheet can be supplied to the press. The high process temperature in the gluing press means that water trapped in such humid zones is converted to vapour. When a plywood board exits from the press it is no longer subjected to any external pressure keeping the water enclosed. Consequently, the vapour expands so that one or more of the sheet layers in the plywood boards will burst and the board must be rejected. In prior art drying equipment the occurrence frequency of this physical phenomenon is so high that the rejection percentage becomes embarrassingly high. The reason for this is that—in spite of the humidity checking and the redrying above referred to—one cannot safely assume that humid zones will not reach the press.

One object of the present invention is to provide a more complete drying by selective concentration of the microwave energy to the humid zones. This results in a drastic reduction of the rejection percentage.

The veneer sheets are rectangular and produced by subjecting wood logs to a turning operation. The fibres of the wood do then get oriented parallel to the short sides of the rectangle. If the turning tool has cut in such a way that the ends of a fibre are not exposed in the plane of the sheet, the water inside the fibre will be mechanically trapped therein. Consequently, a plurality of such fibres form a humid zone extending transversely to the direction in which the sheet is transported through the drier. The distance between such zones may vary between a few centimeters and several decimeters. It should, however, be observed that also the areas between these zones contain water the presence of which is, however, not equally critical. But under all circumstances a remaining amount of water caused by underdrying is undesired, already for the reason that it means lack of homogenity in the product.

Therefore, a further object of the invention is to make it possible not only to reduce the water content in the veneer sheets exiting from the press but also to distribute the remaining amount of water in the sheet so that, from a humidity point of view, it can be considered homogeneous.

SUMMARY OF THE INVENTION

The above-mentioned and other objects of the invention have been realized in the way that microwave energy is supplied only within the downstream sections of the drier and in the form of multi-resonances in the duct. The product is caused to pass outside the ducts but close to exit openings therein which are dimensioned and disposed in such a way that the near field exiting through them covers substantially the total area of the product but is essentially only tapped through those openings past which underdried zones pass.

It should already here be stressed that the physical mechanism used is known per se, namely the fact that the absorption of microwave energy in a humid cellulose product has its maximum in the water inside the material. The next highest absorption occurs in substances containing OH-radicals, in the first place lignin and resin, whereas only a small portion of the heat generation takes place in the wooden material proper. A description of how this mechanism can be used is found, e.g. in my Swedish Patent No. 8007239-0, Publication No. 423 931. However, compared to the invention disclosed in that patent and to other known applications of microwave drying of cellulose products the present invention exhibits several unique and specific characteristics. They will be discussed in detail below but already here attention can be drawn to one important difference over the just-mentioned patent, namely the fact that it relates to drying inside a closed drying chamber, i.e. to a discontinuous method, whereas the present invention, as appears from what has been said, relates to the drying of products fed through a drying machine, a continuous method. In addition to the difference continuous/discontinuous a second important difference is that the products are not exposed to microwave energy inside a closed space directly connected to the microwave generator but in an area outside the field-distributing structure.

U.S. Pat. No. 3,622,733 proposes a drying process using hot air as well as microwaves. The corresponding apparatus, which is provided with conventional meander wave-guides, is however not capable of generating the field pattern attained thanks to the present invention. Also, the operational costs of that prior art apparatus are so high that it lacks interest for practical/commercial use. The reason for this is that the drying is to a very considerable extent carried out with the use of microwave energy which requires high amounts of such energy. In contrast thereto, according to the present invention, that drying method is used in a selective way. This means that it is used—in the downstream sections of the drier—only for the purpose of drying the "humid spots" which have not been mastered by the hot air sections of the drier during the passage of the material therethrough.

DETAILED DESCRIPTION OF THE INVENTION

One embodiment of the invention will now be described in detail, reference being made to the accompanying drawings.

Figure 1:
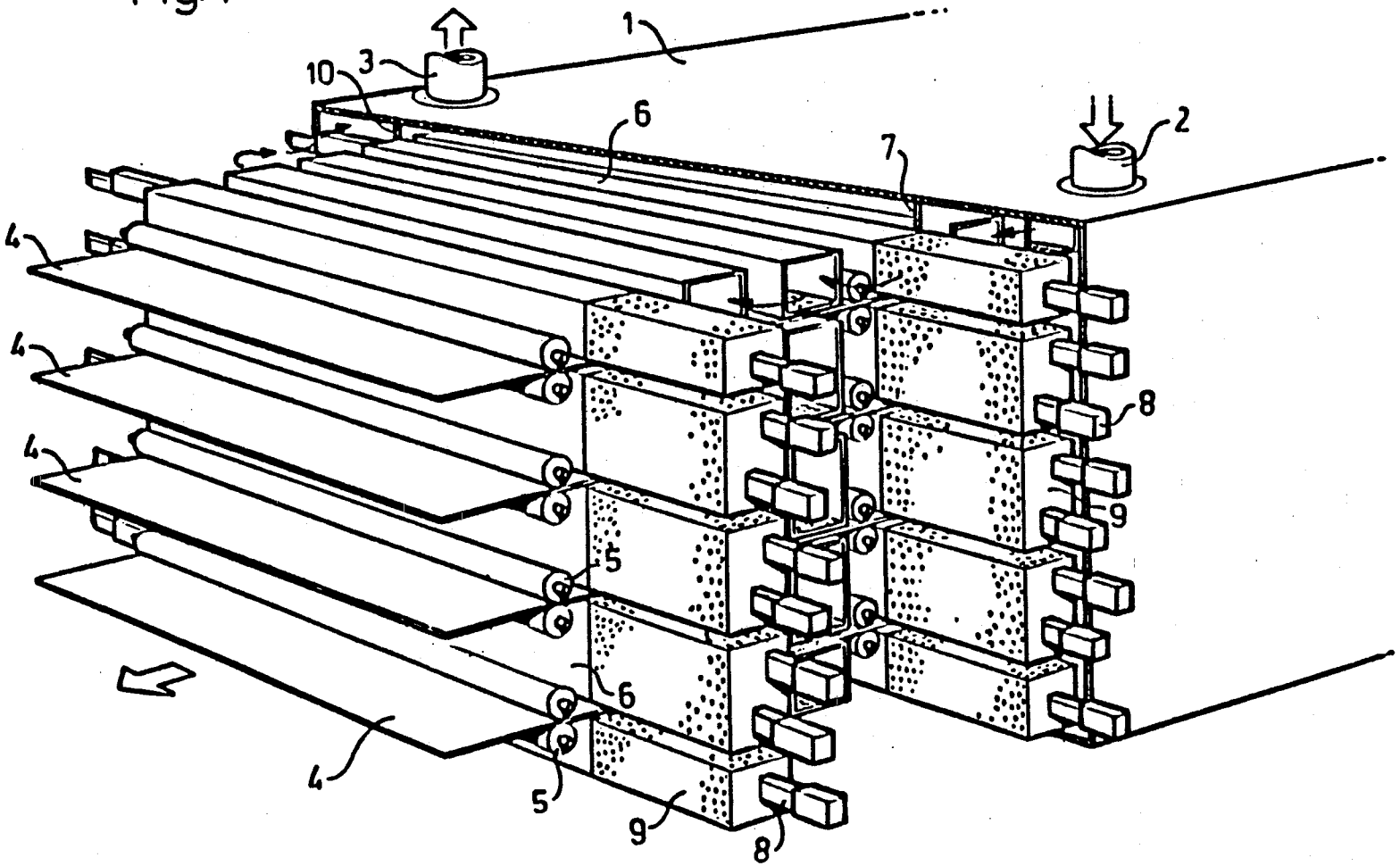
FIG. 1 is a perspective view showing a portion of a roller drier for simultaneous drying of a plurality of wood veneer webs, in the present case four webs, which are fed above each other.

FIG. 1 shows the exit section of a roller drier having a casing 1 part of which has been removed to show the structure of the internal components. Numerals 2 and 3 refer to conduits for inlet and outlet hot air, respectively. Four veneer sheets 4 are fed above each other between pairs of rollers 5. Transverse to the feeding direction F extends a plurality of ducts 6 supplied with hot air from the inlet which is by a partition 7 shielded off from the rest of the space inside the casing. The hot air flows axially through the ducts. A number of these, according to the embodiment illustrated those in every third vertical column, are at their ends provided with magnetrons 8 supplying microwave energy via boxes 9. Each of these boxes is air-tight connected to one of the ducts at the inlet end thereof. As has been shown, the boxes are perforated to permit air inlet. However, those perforations are so small that the microwaves cannot exit through them. Accordingly, there does inside each magnetron-equipped duct appear two media, hot drying air and microwaves. The duct outlet ends are sealingly connected to an outlet chamber which in the same way as at the inlet end is formed by the provision of a partition 10 inside the casing 1. From that outlet chamber the air exits through conduit 3, after having first passed through openings in the duct bottoms and tops towards the sheets 4 for the purpose of drying them. The top and bottom duct in each magnetron-equipped column has a closed top and a closed bottom, respectively, and their height is just about half of the height of the intervening ducts because they do each serve just one of sheets 4.

Inside the ducts the microwave energy appears in the form of standing waves. This resonance phenomenon arises thanks to a suitable dimensioning of the ducts to which will be reverted below.

Figure 2:
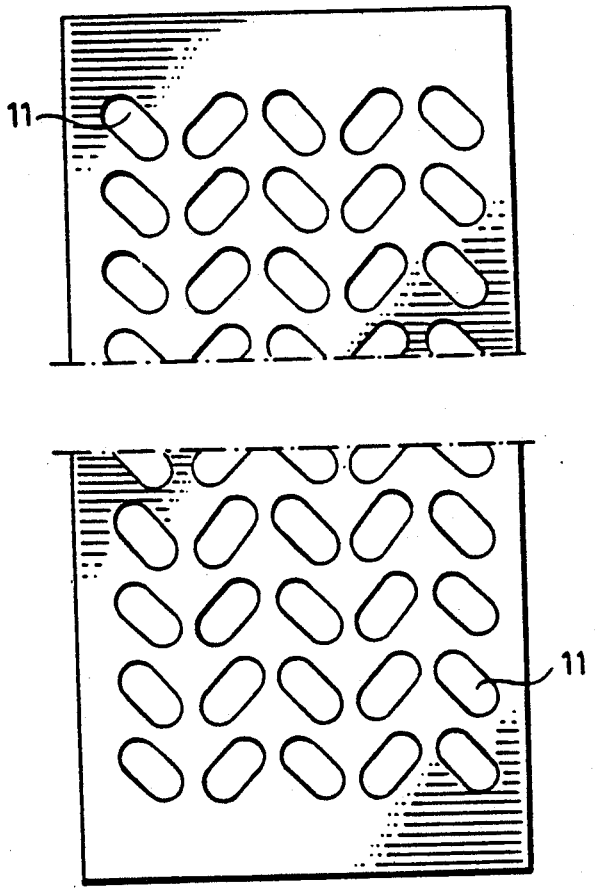
FIG. 2 shows a preferred arrangement of the openings in the sides of the hot air ducts facing the product under treatment.

FIG. 2 does, only to exemplify, show an arrangement of the openings 11 for air and microwaves, in this case a herringbone pattern. That arrangement which does per se belong to the prior art has the advantage that, thanks to the partial overlapping in the longitudinal direction of the ducts, i.e. transverse to the transport direction of sheets 4, every sheet surface area will be exposed to microwaves. According to a typical embodiment the size of the openings may be approximately 20×9 mms. Corresponding results can be obtained with openings of T or L configuration.

The central characteristics of the invention can be summarized in the following manner.

It has above already been stressed that the method is continuous, meaning that the load is in continuous movement relatively the applicator. However, in spite of that movement the load may be looked upon as constant, since in any arbitrary longitudinal section of the veneer sheet as counted in the transport direction, the width, thickness and the structural properties, including the humidity content, are the same and the transport speed is kept constant.

In contrast to both discontinuous methods, where the load is in principle stationary placed in a big chamber and the field pattern could rather be described as load-dependent field variations than as resonances determined by the chamber configuration, and continuous methods where the load passes through a tunnel applicator, it is an important characteristic of the invention that the load is located outside the applicator. As a matter of fact the latter can be looked upon both as an applicator and as a wave-guide.

On the other hand, the load must be located close to the applicator microwave energy outlet openings. The reason for this is that the dielectricity constant of the load, or its "refraction index", is greater than 1. The more humid the load the greater its refraction index which means that the waves are compressed, the wave length is somewhat reduced. Accordingly, the high humidity content, equivalent to a high dielectricity constant, means a high absorption of microwave energy in the load and this also when the openings in the applicator wall are relatively small. In other words, the location of the load should be so that the energy transmission occurs in the near field.

A related condition is that the thickness of the load should be small in the propagation direction of the microwaves, i.e. perpendicular to the load transport direction. In any case the thickness should be inferior to about half a wavelength so that the near field condition is satisfied.

As has been mentioned, another important difference relatively the prior art is that, according to the present invention, the load is exposed to a very high power density. Due to the comparatively low thickness of the load it is logical to consider the power density in terms of surface units rather than volume units and a typical value will then be 100 W/dm$^2$. If that value is compared to the prior art values of 20–100 W/kg the ratio will be about three ten powers. In a plant of the type here discussed used for drying veneer webs the number of ducts could be e.g. 800, in which case the total heat power supplied as hot air can be 6 MW corresponding to 5–10 kW pro duct. In the ducts also supplied with microwave power this may amount to about 50% of the hot air power, e.g. 3 kW for a single duct and 5 kW for a duct having outlet openings at both sides (at the top and in the bottom).

The ducts are dimensioned as a function of the wavelength, typically 12 cms, and to generate a field pattern that is homogeneous in the duct longitudinal direction. As appears from what has been said above, this means that the total field shall be composed by a plurality of standing waves. When, as is usually the case, the ducts have a rectangular cross-section, not more than one of the two dimensions width and height should be inferior to one wavelength, approximately 12 cms, for optimal technical operation. Further, the number of resonances, or standing waves, is inversely proportional to the duct volume. Above the approximate value 0.1 m$^3$ these problems are very insignificant. If the duct height is 36 cms and the duct width 12 cms, that volume corresponds to a duct length of about 3 m which adequately covers the conditions in a roller drier.

As to the duct outlet openings for hot air and microwave energy it has been mentioned that, in respect of both these flows, one does as a matter of principle strive to get homogeneity, or a zero gradient, in the duct longitudinal direction. The air may pass out through a continuous, longitudinal slot diverging in the flow direction. The ducts may consist of e.g. aluminum which material confines both flows. A reduction of the total air outlet area can be achieved in the way that the adjacent walls consist of e.g. teflon which is permeable to microwave energy but not to air and can withstand the residing temperature, about 200° C. The number, size and positions of the microwave energy outlet openings must generally be determined in each actual case. The outgoing microwave energy, as seen by the applicator "losses", must be kept so low that the Q-value, the ratio between oscillating and lost energy, is not too low. Typically it may be between 100 and 40. It may prove necessary to optimize the opening pattern along all of the propagation direction of the wave energy, i.e. the longitudinal direction of the duct, but in other cases all openings may be identical. One condition must however be satisfied in this context, namely that the configuration and size of the openings must be selected so that the radiation will for certain hit every point of the passing load. For that purpose the openings can be shaped like slots arranged in a herringbone pattern or in other ways be given different polarization directions, e.g. given T or L configuration.

For the sake of simplification it has above been presumed that the supply of microwave energy to the ducts takes place at the one duct end only, it also having been implicit that a microwave generator, in the form of one or more magnetrons or the like, has been connected to each such duct. However, none of these two criterions are a characteristic of the present invention. Each duct can be fed from two or more microwave generators and, conversely, one generator can feed several adjacent ducts. Further, microwave energy can be supplied at both duct ends, the electric coupling being made so that the standing waves do not coincide but are in terms of position mutually offset in phase whereby the field pattern becomes as homogeneous as possible.

By way of example, if the one of two waveguides is in a geometrical sense rotated by 90°, two different resonance field combinations are created. One can also obtain a time difference between the field excitations by the use of a three-phase system giving modulated half-wave rectification so that each generator is excited only when the other two are passive.

What is claimed is:

1. A method for drying sheet or web products, which are conveyed through a drying plant, where the product is dried by a hot air flow and, during passage through the plant, is also radiated with microwave energy supplied through transverse ducts to dry underdried zones in the product, characterized by: supplying the microwave energy only in exit end sections of the plant and in the form of multiresonances in the ducts, and causing the product to pass outside the ducts but close to duct outlet openings which are dimensioned and located such that the near field of the microwave energy exiting therethrough covers substantially all of the product surface but is essentially tapped only through such openings past which underdried zones are moving.

2. A method as claimed in claim 1, characterized by the use of planar openings (11) the maximum dimension of which is about half a free microwave length, or less.

3. A method as claimed in claims 1 or 2, characterized by the use of openings in the form of slots arranged in one of a fishbone pattern, a T configuration and an L configuration.

4. An apparatus for drying sheet (4) or web products, which are conveyed through a drying plant, where the product is dried by a hot air flow, means (8) being arranged during the product passage through the plant to also radiate it with microwave energy supplied through transverse ducts (6) for the purpose of drying underdried zones in the product, characterized by: said radiating means being arranged to supply the microwave energy only in exit end sections of the apparatus and in the form of multiresonances in the ducts, the product being caused to pass outside the ducts (6) but close to duct outlet openings (11) which are dimensioned and located such that the near field of the microwave energy exiting therethrough covers substantially all of the product surface but is essentially tapped only through those openings past which underdried zones are moving.

5. An apparatus as claimed in claim 4, wherein the maximum dimension of said openings (11) is about half a free microwave length, or less.

6. An apparatus as claimed in claim 5, wherein said openings comprise slots arranged in one of a fishbone pattern, a T configuration and an L configuration.

* * * * *